US009274501B2

(12) United States Patent
Okabe

(10) Patent No.: US 9,274,501 B2
(45) Date of Patent: Mar. 1, 2016

(54) DRIVE FORCE TRANSMISSION CONFIGURATION FOR AN IMAGE FORMING APPARATUS HAVING CARTRIDGE

(71) Applicant: Yasushi Okabe, Nagoya (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 65 days.

(21) Appl. No.: 14/174,982

(22) Filed: Feb. 7, 2014

(65) Prior Publication Data

US 2014/0227003 A1 Aug. 14, 2014

(30) Foreign Application Priority Data

Feb. 8, 2013 (JP) ..... 2013-023032

(51) Int. Cl.
*G03G 21/16* (2006.01)
*G03G 21/18* (2006.01)

(52) U.S. Cl.
CPC ..... *G03G 21/186* (2013.01); *G03G 21/1623* (2013.01); *G03G 21/1647* (2013.01)

(58) Field of Classification Search
CPC ..... G03G 21/1803
See application file for complete search history.

(56) References Cited

U.S. PATENT DOCUMENTS

| | | | | |
|---|---|---|---|---|
| 8,583,006 | B2 | 11/2013 | Murayama et al. | |
| 2007/0019990 | A1* | 1/2007 | Murofushi | 399/167 |
| 2007/0122175 | A1* | 5/2007 | Sato | G03G 15/065 399/90 |
| 2008/0159773 | A1 | 7/2008 | Murayama et al. | |
| 2010/0080627 | A1* | 4/2010 | Takamura | G03G 21/1864 399/167 |
| 2010/0166462 | A1* | 7/2010 | Igarashi | 399/155 |
| 2012/0177403 | A1 | 7/2012 | Murayama et al. | |

FOREIGN PATENT DOCUMENTS

JP 2008-165025 A 7/2008

* cited by examiner

*Primary Examiner* — David Gray
*Assistant Examiner* — Geoffrey Evans
(74) *Attorney, Agent, or Firm* — Banner & Witcoff, Ltd.

(57) ABSTRACT

An image forming apparatus includes: a main body provided with a drive-force supplying part; a cartridge comprising a rotary body and a drive-force transmission part; and a moving member supporting the cartridge. The drive-force transmission part transmits a drive force transmitted from the drive-force supplying part to the rotary body. The moving member is accommodated in and withdrawn from the main body. The cartridge is attached to and detached from the moving member when moving member is withdrawn from the main body. The moving member includes a drive-force relay part having an input portion and an output portion, the input portion receiving the drive force from the drive-force supplying part, the output portion outputting the drive force from the input portion to the drive-force transmission part of the cartridge attached to the moving member.

7 Claims, 6 Drawing Sheets

DRIVE FORCE TRANSMISSION CONFIGURATION FOR AN IMAGE FORMING APPARATUS HAVING CARTRIDGE

CROSS REFERENCE TO RELATED APPLICATION

This application claims priority from Japanese Patent Application No. 2013-023032 filed Feb. 8, 2013. The entire content of the priority application is incorporated herein by reference.

TECHNICAL FIELD

The present invention relates to an image forming apparatus of an electro-photographic type.

BACKGROUND

A known tandem-type color printer includes a main body and a plurality of cartridges detachably mountable in the main body.

One of such conventional color printers includes a main body and a cartridge tray configured to be held in the main body to be slidable movable relative to the main body. In this color printer, the cartridge tray supports therein a plurality of cartridges juxtaposed to one another. That is, the plurality of cartridges is integrally and detachably mountable in the main body (see Japanese Patent Application Publication No. 2008-165025).

SUMMARY

It is an object of the present invention to provide an improved image forming apparatus.

In order to attain the above and other objects, there is provided an image forming apparatus including a main body, a cartridge and a moving member. The main body is provided with a drive-force supplying part configured to rotate to generate and transmit a drive force. The cartridge includes a rotary body and a drive-force transmission part, the rotary body defining a rotational axis extending in a first direction, the drive-force transmission part being configured to transmit the drive force from the drive-force supplying part to the rotary body. The moving member is configured to support the cartridge therein and to move in a second direction generally perpendicular to the first direction between an internal position accommodated in the main body and an external position withdrawn from the main body, the cartridge being configured to be attached to and detached from the moving member in the external position, the moving member comprising a drive-force relay part including an input portion and an output portion, the input portion being configured to receive the drive force from the drive-force supplying part of the main body, the output portion being configured to output the drive force from the input portion to the drive-force transmission part of the cartridge attached to the moving member.

According to another aspect of the invention, there is provided an image forming apparatus including a main body, a tray configured to move into or be pulled out of the main body, and a cartridge configured to be attached to and detached from the tray. The main body is provided with a drive-force supplying member configured to transmit a drive force. The cartridge includes a rotary body and a drive-force transmission member, the drive-force transmission member being configured to transmit the drive force from the drive-force supplying member of the main body to the rotary body. The tray includes a drive-force relay member configured to transmit the drive force from the drive-force supplying member of the main body to the drive-force transmission member of the cartridge.

DETAILED DESCRIPTION

1. General Structure of the Printer

Figure 1:
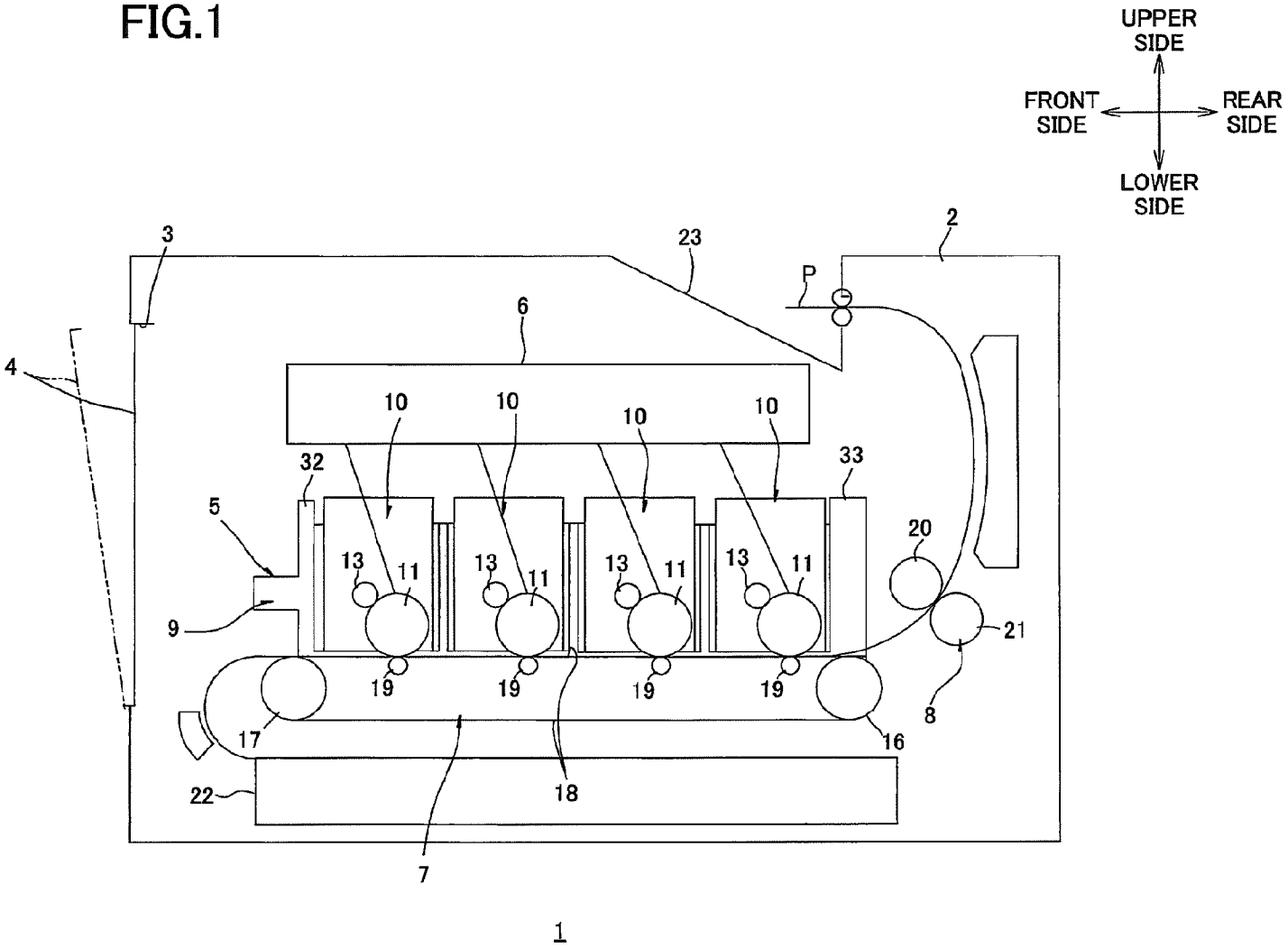
FIG. 1 is a schematic central cross-sectional view illustrating a general configuration of a printer according to a first embodiment of the present invention, wherein a process frame supporting a plurality of process cartridges is accommodated in a main casing of the printer.

A printer 1 is a horizontal direct tandem-type color laser printer, as shown in FIG. 1. The printer 1 is an example of an image forming apparatus according to a first embodiment of the present invention.

First, a general structure of the printer 1 will be described with reference to FIG. 1.

Throughout the specification, the terms "above", "below", "right", "left", "front", "rear" and the like will be used assuming that the printer 1 is resting on a level surface. More specifically, in FIG. 1, a right side, a left side, a near side and a far side will be referred to as a rear side, a front side, a right side and a left side of the printer 1, respectively.

The printer 1 includes a substantially box-shaped main casing 2, a process unit 5, a scanner unit 6, a transfer unit 7, and a fixing unit 8.

The main casing 2 includes an aperture 3 and a front cover 4. The front cover 4 is provided on the main casing 2 such that the front cover 4 is pivotably movably about a lower end portion thereof to open and close the aperture 3.

The process unit 5 includes a process frame 9 and four process cartridge 10 supported to the process frame 9.

The process frame 9 is formed in a substantially rectangular frame-like shape. The process frame 9 supporting the process cartridges 10 is configured to move, relative to the main casing 2, in a front-rear direction between a mounted position (shown in FIG. 1) and a pull-out position (shown in FIG. 4). Specifically, the process frame 9 is accommodated in the main casing 2 in the mounted position, whereas the process frame 9 is pulled out frontward from the main casing 2 in the pull-out position.

The four process cartridges 10 are arranged in parallel to and spaced apart from one another in the front-rear direction. Each of the process cartridges 10 includes a photosensitive drum 11, a developing roller 13, a supply roller (not shown), and a thickness regulating blade (not shown).

The photosensitive drum 11 is formed in a substantially cylindrical shape elongated in a left-right direction. The photosensitive drum 11 is rotatably supported to a lower end portion of the process cartridge 10.

The developing roller 13 is disposed upward of and frontward of the photosensitive drum 11 so as to be in contact with the same. The developing roller 13 has a substantially columnar shape extending in the left-right direction. That is, the developing roller 13 defines a central axis extending in the left-right direction. The developing roller 13 is rotatable about the central axis.

In each process cartridge 10, toner is stored in a chamber (not shown) formed upward of the developing roller 13. The supply roller (not shown) is configured to supply this toner to the corresponding developing roller 13. The thickness regulating blade (not shown) is configured to regulate a thickness of the toner supplied to the developing roller 13.

The scanner unit 6 is placed in an upper portion of the main casing 2. The scanner unit 6 is configured to emit a laser beam to each of the plurality of photosensitive drums 11 based on image data to expose each of the photosensitive drums 11 to light.

The transfer unit 7 is disposed below the process unit 5, i.e., below the four photosensitive drums 11. The transfer unit 7 includes a drive roller 16, a follow roller 17, a conveyor belt 18, and four transfer rollers 19.

The drive roller 16 is rotatably supported in a rear end portion of the transfer unit 7. The follow roller 17 is rotatably supported in a front end portion of the transfer unit 7.

The conveyor belt 18 is stretched on and around the drive roller 16 and the follow roller 17 under tension. The conveyor belt 18 has an upper portion that is in contact with each of the photosensitive drums 11 from below. Rotation of the drive roller 16 causes the follow roller 17 to rotate in conjunction with the conveyor belt 18. The conveyor belt 18 is thus configured to be circularly movable such that the upper portion of the conveyor belt 18 moves from the front to the rear The four transfer rollers 19 are disposed below the four photosensitive drums 11 respectively such that each pair of transfer roller 19 and the photosensitive drum 11 nips the upper portion of the conveyor belt 18 therebetween.

The fixing unit 8 is disposed rearward of and upward of the transfer unit 7. The fixing unit 8 includes a heating roller 20 and a pressure roller 21 disposed in opposition to each other.

Upon input of a print job in the printer 1, an image formation operation is initiated. The toner stored in each process cartridge 10 is tribocharged with a positive polarity between the supply roller (not shown) and the corresponding developing roller 13, and is borne on a surface of the corresponding developing roller 13 as a thin layer of a uniform thickness by the thickness regulating blade (not shown).

In the meantime, a charger (not shown) applies a uniform positive charge to a surface of each photosensitive drum 11. The scanner unit 6 then exposes the surface of each photosensitive drum 11 to light based on prescribed image data, thereby forming an electrostatic latent image on the surface of each photosensitive drum 11 based on the image data. The toner borne on each developing roller 13 is then supplied to the electrostatic latent image on the surface of the corresponding photosensitive drum 11. A toner image is thus carried on the surface of each photosensitive drum 11.

Sheets P are accommodated in a sheet feed tray 22 disposed in a bottom portion of the main casing 2. Various rollers (not shown) are configured to convey the sheets P upward and rearward, along a U-shaped path, such that each sheet P is conveyed toward a position between the frontmost photosensitive drum 11 and the conveyor belt 18 one by one at a predetermined timing. The conveyor belt 18 then conveys each sheet P rearward such that each sheet P passes between each photosensitive drum 11 and its corresponding transfer roller 19. As each sheet P is conveyed rearward with a transfer bias applied to each transfer roller 19, the toner image carried on each of the photosensitive drums 11 is sequentially transferred onto the sheet P.

The sheet P is then applied with heat and pressure when passing between the heating roller 20 and the pressure roller 21 in the fixing unit 8. The toner image is thus thermally fixed on the sheet P.

Thereafter, the sheet P is then conveyed upward and frontward along a U-shaped path, and is finally discharged onto a discharge tray 23 formed on in an upper wall of the main casing 2.

2. Process Unit

(2-1) Process Frame

Figure 2:
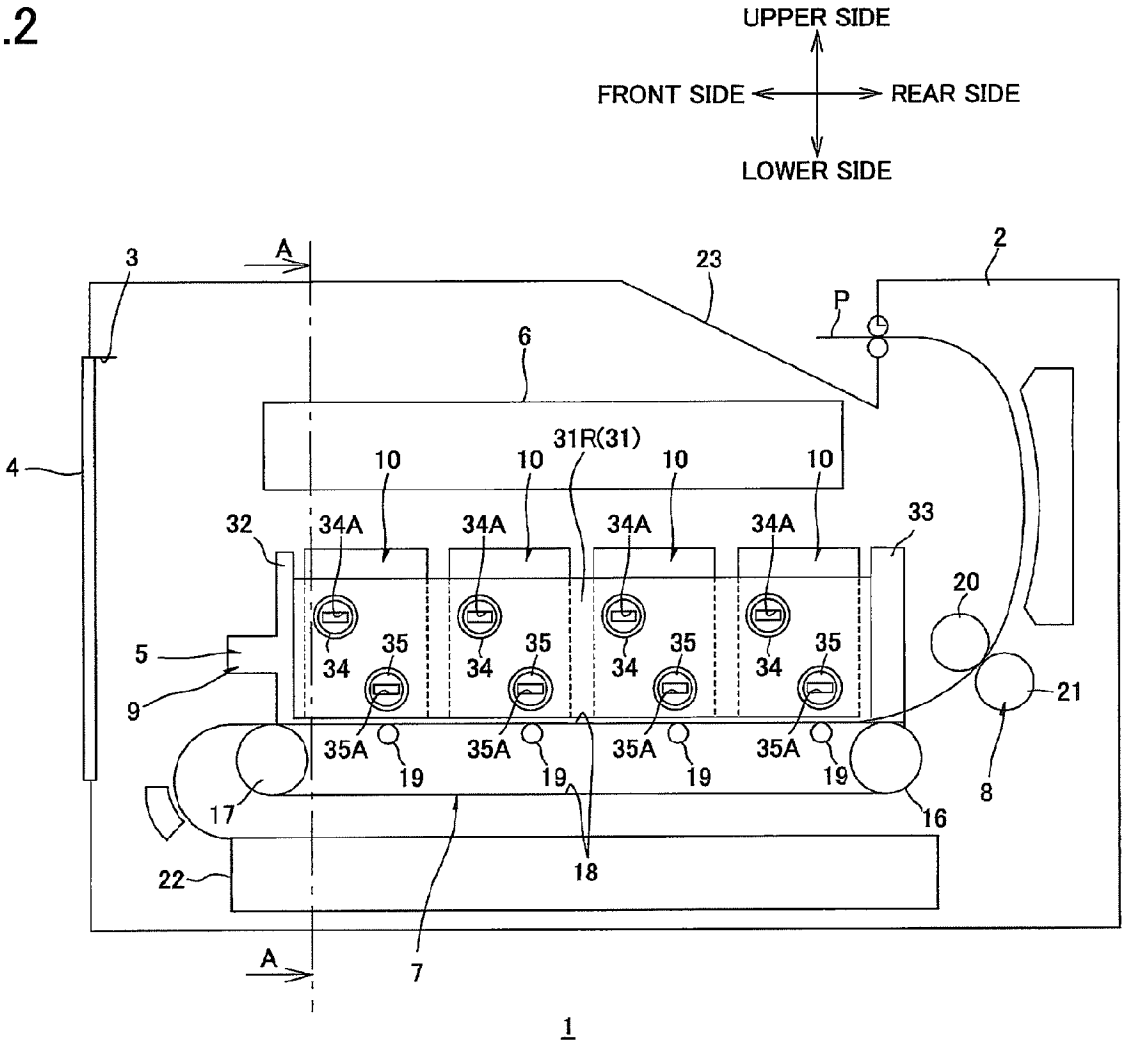
FIG. 2 is a schematic view showing a right side view of each of the plurality of process cartridges when mounted in the printer according to the first embodiment.
Figure 3:
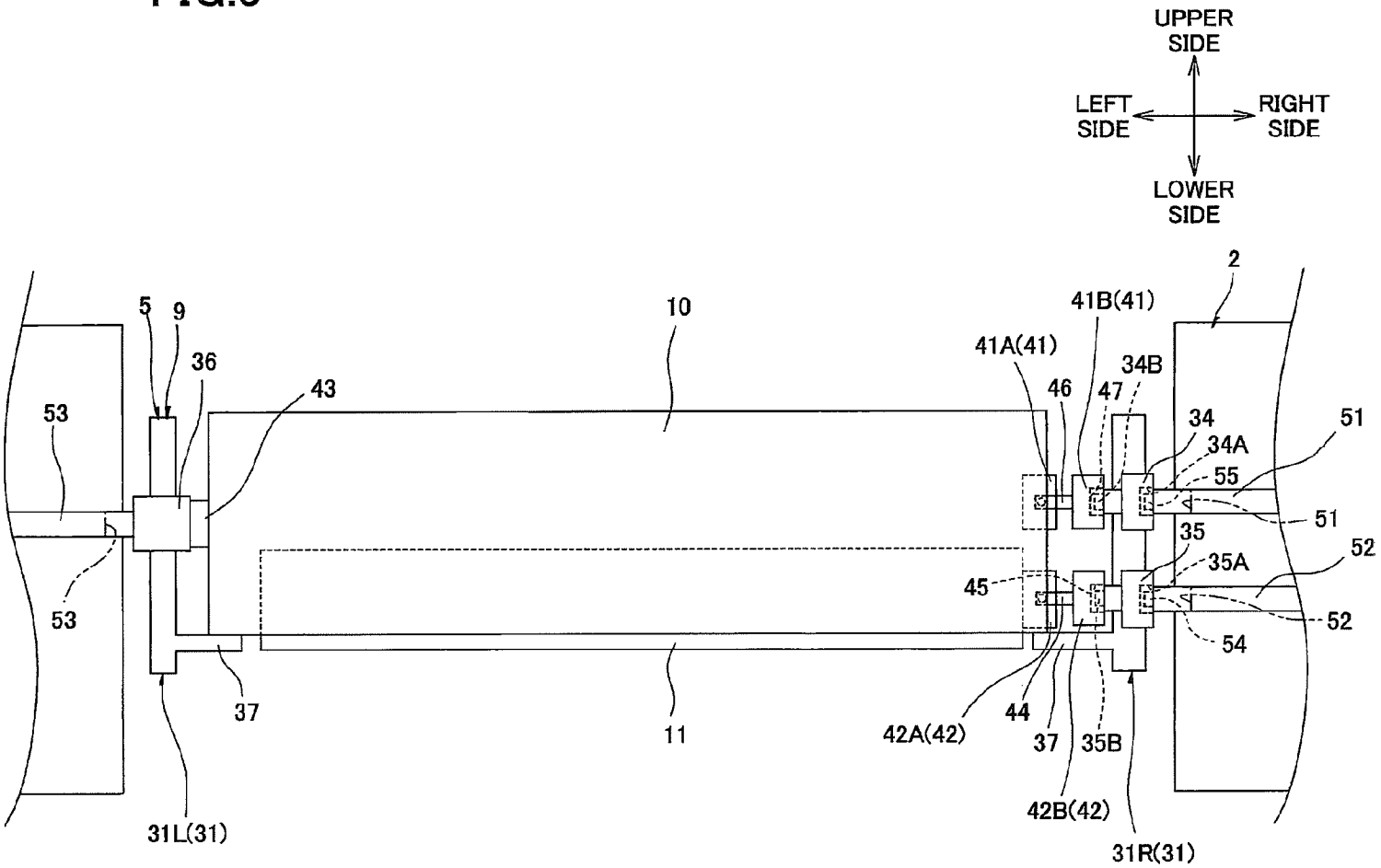
FIG. 3 is a cross-sectional view of the printer according to the first embodiment taken along a plane A-A shown in FIG. 2.

As shown in FIGS. 2 and 3, the process frame 9 includes a pair of left and right side plates 31, a front beam 32, and a rear beam 33.

The side plates 31 are disposed to oppose and be spaced apart from each other in the left-right direction. The side plates 31 have a substantially rectangular plate-like shape elongated in the front-rear direction in a side view.

Each of the side plates 31 has a lower end portion on which a support rib 37 is formed to support the process cartridges 10. Specifically, the support rib 37 protrudes inward from an inner surface of the lower end portion of each side plate 31 in the left-right direction. The support rib 37 is in a form of a rib (protrusion) extending in the front-rear direction.

Hereinafter, for explanatory purpose, the left side plate 31 will be referred to as the left side plate 31L, while the right side plate 31 will be referred to as the right side plate 31R, whenever necessary.

As shown in FIG. 3, the left side plate 31L includes four relay electrodes 36 to correspond to the four process cartridges 10.

The relay electrodes 36 are disposed vertically midway on the left side plate 31L in an up-down direction. The relay electrodes 36 are made of an electrically conductive material such as metal or electrically conductive resin. The relay electrodes 36 are generally columnar shaped and extend to penetrate the left side plate 31L in the left-right direction. The four relay electrodes 36 are spaced apart from one another in the front-rear direction to correspond to the four process cartridges 10.

The right side plate 31R includes four drum relay couplings 35 and four developing relay couplings 34.

The drum relay couplings 35 are provided on a lower end portion of the right side plate 31R. The drum relay couplings 35 are arranged to be spaced away from one another in the front-rear direction so as to correspond to four drum couplings 42 (described later) of the photosensitive drums 11. The drum relay couplings 35 are formed in a substantially columnar shape extending in the left-right direction. Each drum relay coupling 35 penetrates the right side wall 31R in the left-right direction. Each drum relay coupling 35 includes an input portion 35A and an output portion 35B.

The input portion 35A is formed in a right end portion of each drum relay coupling 35 in a form of a recess. Specifically, the input portion 35A is recessed leftward from a right surface of the drum relay coupling 35.

The output portion 35B is formed in a left end portion of each drum relay coupling 35 in a form of a protrusion. Specifically, the output portion 35B has a generally columnar shape and protrudes leftward from a left surface of each drum relay coupling 35.

The four developing relay couplings 34 are provided on an upper portion of the right side plate 31R. The developing relay couplings 34 are arranged to be spaced away from one another in the front-rear direction such that each developing relay coupling 34 corresponds to a developing coupling 41 (described later) provided in each process cartridge 10. Further, as shown in FIG. 2, each developing relay coupling 34 is positioned diagonally upward and frontward of the corresponding drum relay coupling 35. The developing relay couplings 34 have a substantially columnar shape, extending in the left-right direction to penetrate the right side wall 31R in the left-right direction. Each developing relay coupling 34 includes an input portion 34A and an output portion 34B.

The input portion 34A is formed in a right end portion of each developing relay coupling 34 in a form of a recess. Specifically, the input portion 34A is recessed leftward from a right surface of each developing relay coupling 34.

The output portion 34B is formed in a left end portion of each developing relay coupling 34 in a form of a protrusion. Specifically, the output portion 34B protrudes leftward from a left surface of each developing relay coupling 34.

The front beam 32 is provided to bridge front end portions of the two side plates 31. The front beam 32 has a generally plate-like shape extending in the left-right direction.

The rear beam 33 bridges between rear end portions of the two side plates 31. The rear beam 33 has a generally plate-like shape extending in the left-right direction.

(2-2) Process Cartridge

The process cartridges 10 are substantially box-shaped and elongated in the left-right direction, as shown in FIG. 3. Each process cartridge 10 includes a cartridge electrode 43, the drum coupling 42, and the developing coupling 41.

The cartridge electrode 43 is disposed vertically midway in a left wall constituting an outer casing of each process cartridge 10. The cartridge electrode 43 has a generally plate-like shape and is made of an electrically conductive material such as metal or electrically conductive resin. Although not shown in the drawings, the cartridge electrode 43 is electrically connected to the corresponding developing roller 13 for supplying power thereto.

The drum coupling 42 is disposed on a right end portion of each photosensitive drum 11. The drum coupling 42 includes a supported portion 42A and a pivoting portion 42B.

The supported portion 42A is formed in a substantially columnar shape extending in the left-right direction. The supported portion 42A is supported to the right end portion of the photosensitive drum 11 so as not to rotate relative to the same.

The pivoting portion 42B is formed in a substantially columnar shape extending in the left-right direction. The pivoting portion 42B includes a pivot shaft 44 and a coupled portion 45.

The pivot shaft 44 has a generally rod-like shape and extends leftward from a left end portion of the pivoting portion 42B. The pivot shaft 44 has a left end portion pivotally movably supported to a right end portion of the supported portion 42A. The left end portion of the pivot shaft 44 cannot rotate relative to the right end portion of the supported portion 42A.

The coupled portion 45 is formed in a right end portion of the pivoting portion 42B in a form of a recess. Specifically, the coupled portion 45 is recessed leftward from a right surface of the pivoting portion 42B.

Figure 5A:
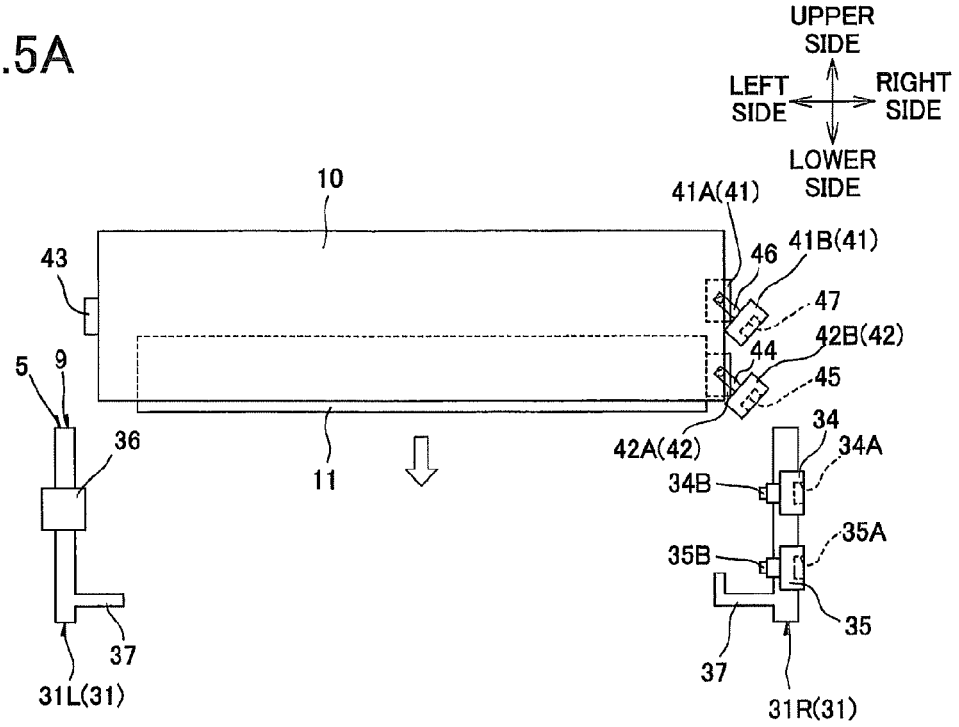
FIG. 5A is a view explaining how the process cartridge is attached to the process frame of the printer according to the first embodiment, wherein the process cartridge is placed above the process frame for attachment.

With this structure, the pivoting portion 42B can pivot relative to the supported portion 42A. Specifically, the pivoting portion 42B is pivotally movable about the left end portion of the pivot shaft 44 between a first inclined position (shown in FIG. 5A) and a first horizontal position (shown in FIGS. 3 and 5C) in a front view. In the first inclined position, the pivot shaft 44 of the pivoting portion 42B is inclined lower right relative to the left-right direction, and in the first horizontal position, the pivot shaft 44 of the pivoting portion 42B extends generally parallel to the left-right direction.

The developing coupling 41 is provided in a right end portion of the process cartridge 10. The developing coupling 41 is positioned upward and frontward of the corresponding drum coupling 42 to correspond to the developing roller 13. The developing coupling 41 includes a supported portion 41A and a pivoting portion 41B.

The supported portion 41A is formed in a substantially columnar shape extending in the left-right direction. The supported portion 41A is rotatably supported to the right end portion of the process cartridge 10. Although not shown in the drawings, the supported portion 41A has a left end portion whose entire circumferential surface is formed with gear teeth thereon. The gear teeth are in engagement with a gear train (not shown) to mechanically connect the supported portion 41A to the developing roller 13.

The pivoting portion 41B is formed in a substantially columnar shape extending in the left-right direction. The pivoting portion 41B includes a pivot shaft 46 and a coupled portion 47.

The pivot shaft 46 is formed in a generally rod-like shape and extends leftward from a left end portion of the pivoting portion 41B. The pivot shaft 46 has a left end portion pivotally movably supported to the supported portion 41A. The pivot shaft 46 is incapable of rotating relative to the right end portion of the supported portion 41A.

The coupled portion 47 is formed in a right end portion of the pivoting portion 41B in a form of a recess. Specifically, the coupled portion 47 is recessed leftward from a right surface of the pivoting portion 41B.

With this structure, the pivoting portion 41B can pivot relative to the supported portion 41A. More specifically, the pivoting portion 41B is pivotally movable about the left end portion of the pivot shaft 46 between a second inclined position (see FIG. 5A) and a second horizontal position (see FIGS. 3 and 5C) in a front view. In the second inclined position, the pivot shaft 46 of the pivoting portion 41B is inclined lower right relative to the left-right direction, whereas in the second horizontal position, the pivot shaft 46 of the pivoting portion 41B extends generally parallel to the left-right direction.

3. Main Casing

The main casing 2 includes four main-body electrodes 53, four drum main-body couplings 52, and four developing main-body couplings 51, as shown in FIG. 3.

The main-body electrodes 53 are disposed in a left wall (shown without a reference numeral in FIG. 3) of the main casing 2. The four main-body electrodes 53 are arranged to be spaced away from one another in the front-rear direction to correspond to the four relay electrodes 36 respectively. The main-body electrodes 53 have a generally pillar shape extending in the left-right direction and are made of an electrically conductive material such as metal or electrically conductive resin. The main-body electrodes 53 are configured to move in the left-right direction between a power supplying position (shown by a solid line in FIG. 3) and a power-supply cancellation position (shown by an imaginary line in FIG. 3). As shown in FIG. 3, the main-body electrode 53 in the power supplying position is advanced rightward from an inner surface of the left wall of the main casing 2 The main-body electrode 53 in the power-supply cancellation position is retracted leftward from the inner surface of the left wall of the main casing 2.

The drum main-body couplings 52 are rotatably provided in a right wall (shown without a reference numeral in FIG. 3) of the main casing 2. The drum main-body couplings 52 are spaced away from one another in the front-rear direction to correspond to the four drum relay couplings 35 respectively. The drum main-body couplings 52 are formed in a substantially columnar shape extending in the left-right direction. The drum main-body couplings 52 are configured to move in the left-right direction between a first driving-force transmission position (shown by a solid line in FIG. 3) and a first driving-force-transmission cancellation position (shown by an imaginary line in FIG. 3). The drum main-body coupling 52 in the first driving-force transmission position is advanced leftward from an inner surface of the right wall of the main casing 2. The drum main-body coupling 52 in the first driving-force-transmission cancellation position is retracted rightward from the inner surface of the right wall of the main casing 2.

Each drum main-body coupling 52 includes an engaging protrusion 54. The engaging protrusion 54 is formed on a left end portion of each drum main-body coupling 52. The engaging protrusion 54 has a generally pillar-like shape and protrudes leftward from a left end face of the drum main-body coupling 52.

The developing main-body couplings 51 are rotatably disposed in the right wall of the main casing 2 each at a position diagonally frontward and upward of each drum main-body coupling 52. The four developing main-body couplings 51 are arranged to be spaced part from one another in the front-rear direction so as to correspond to the four developing relay couplings 34 respectively. The developing main-body couplings 51 are formed in a substantially columnar shape extending in the left-right direction. The developing main-body couplings 51 are configured to move in the left-right direction between a second driving-force transmission position (shown by a solid line in FIG. 3) and a second driving-force-transmission cancellation position (shown by an imaginary line in FIG. 3). The developing main-body coupling 51 in the second driving-force transmission position is advanced leftward from the inner surface of the right wall of the main casing 2, whereas the developing main-body coupling 51 in the second driving-force-transmission cancellation position is retracted rightward from the inner surface of the right wall of the main casing 2.

Each developing main-body coupling 51 includes an engaging protrusion 55. The engaging protrusion 55 is formed on a left end portion of each developing main-body coupling 51. The engaging protrusion 55 has a generally pillar-like shape and protrudes leftward from a left end face of the developing main-body coupling 51.

Figure 4:
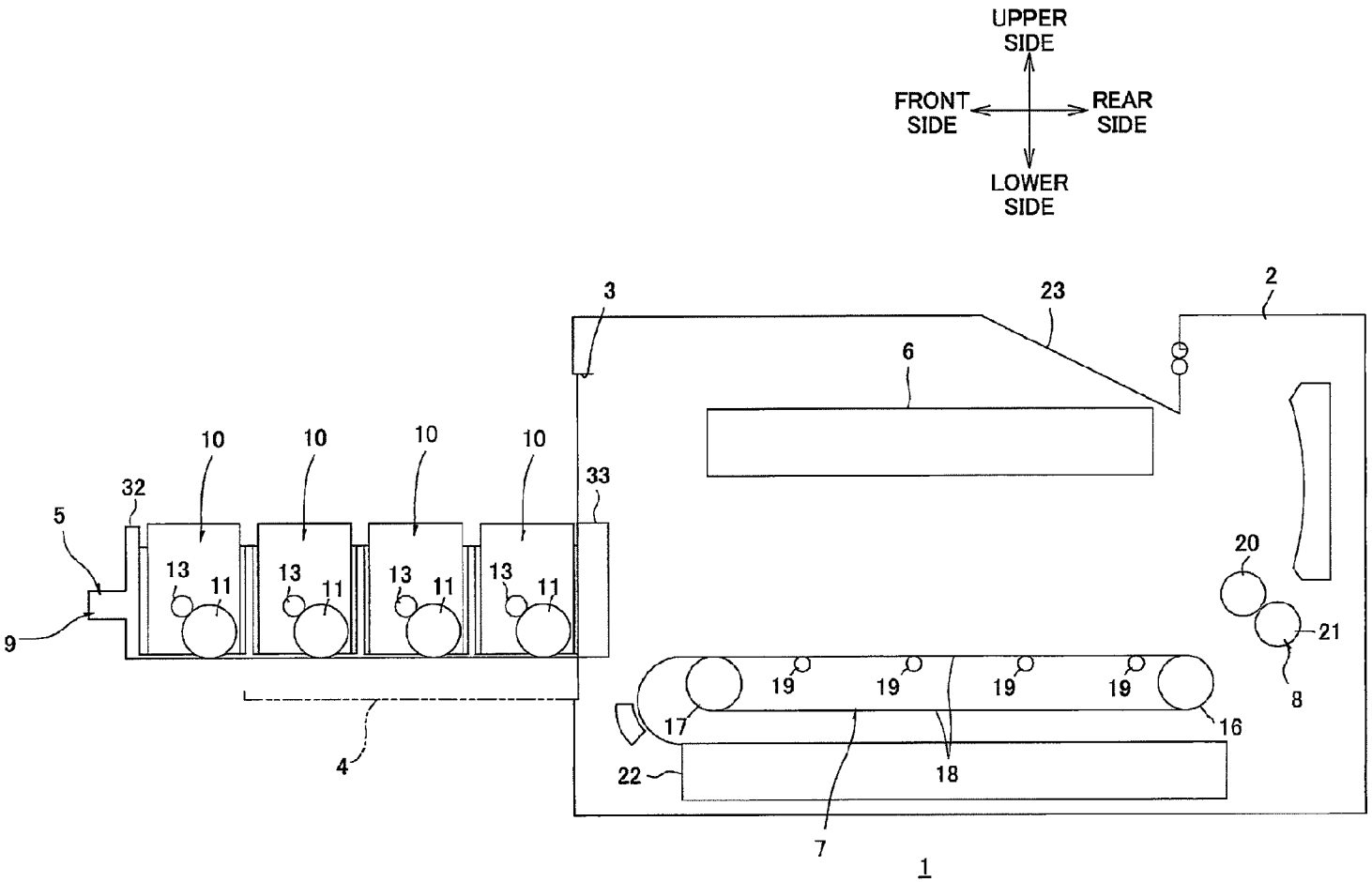
FIG. 4 is a schematic central cross-sectional view of the printer according to the first embodiment, wherein the process frame supporting the plurality of process cartridges is pulled out from the main casing of the printer.

4. Mounting Operation of the Process Cartridges (4-1) Mounting of the Process Cartridges on the Process Frame For mounting the process cartridges 10 in the main casing 2, the process frame 9 is first withdrawn to the pull-out position, as shown in FIG. 4. Then, the process cartridges 10 are mounted on the withdrawn process frame 9.

For mounting the process cartridge 10 on the process frame 9, first, the process cartridge 10 is held with the photosensitive drum 11 facing downward. Then, the process cartridge 10 is placed above the process frame 9.

At this time, the pivoting portion 42B of the drum coupling 42 pivots downward about the left end portion of the pivot shaft 44, due to self-weight of the pivoting portion 42B, such that the pivoting portion 42B has been displaced to the first inclined position. As a result, the coupled portion 45 of the drum coupling 42 is exposed (opened) rightward and downward.

Likewise, the pivoting portion 41B of the developing coupling 41 pivots downward about the left end portion of the pivot shaft 46, due to self-weight of the pivoting portion 41B, such that the pivoting portion 41B has been displaced to the second inclined position. As a result, the coupled portion 47 of the developing coupling 41 is exposed (opened) rightward and downward.

Figure 5B:
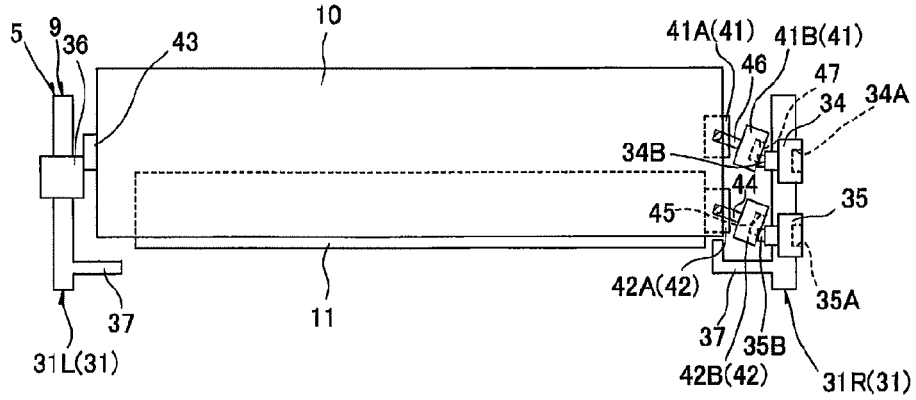
FIG. 5B is a view explaining how the process cartridge is attached to the process frame of the printer according to the first embodiment, wherein the process cartridge is being attached to the process frame.

Then, the process cartridge 10 is inserted into the process frame 9 from above. Consequently, as shown in FIG. 5B, an upper end portion of the coupled portion 45 of the drum coupling 42 comes in contact with the corresponding output portion 35B such that the upper end portion of the coupled portion 45 covers the output portion 35B of the drum relay coupling 35 from above. Likewise, an upper end portion of the coupled portion 47 of the developing coupling 41 comes in contact with the corresponding output portion 34B such that the upper end portion of the coupled portion 47 covers the output portion 34B of the developing relay coupling 34 from above.

Then, the process cartridge 10 is further inserted into the process frame 9. As the process cartridge 10 comes down, the pivoting portion 42B of the drum coupling 42 pivots counterclockwise about the upper end portion of the coupled portion 45 in a front view, and is fitted onto the output portion 35B of the corresponding drum relay coupling 35 from its left side. The pivoting portion 42B is thus coupled to the corresponding output portion 35B so as not to rotate relative to each other.

Similarly, as the process cartridge 10 comes down, the pivoting portion 41B of the developing coupling 41 pivots counterclockwise about the upper end portion of the coupled portion 47 in a front view, and is fitted onto the output portion 34B of the corresponding developing relay coupling 34 from its left side. The pivoting portion 41B is thus coupled to the corresponding output portion 34B so as not to rotate relative to each other.

Figure 5C:
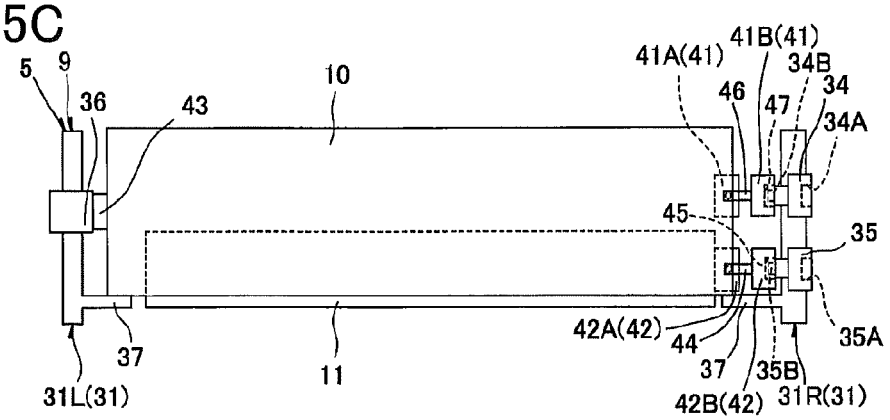
FIG. 5C is a view explaining how the process cartridge is attached to the process frame of the printer according to the first embodiment, wherein the process cartridge has been attached to the process frame.

As a result, as shown in FIG. 5C, the pivoting portion 42B of the drum coupling 42 now extends substantially horizontally (substantially parallel to the left-right direction), and is in the first horizontal position. The pivoting portion 41B of the developing coupling 41 now extends substantially horizontally (substantially parallel to the left-right direction), and is in the second horizontal position.

Incidentally, in the meantime, the cartridge electrode 43 of the process cartridge 10 is received in and fitted with the corresponding relay electrode 36 of the left side plate 31L of the process frame 9.

The mounting of the process cartridge 10 on the process frame 9 is thus completed.

For detaching the process cartridge 10 from the process frame 9, the procedures to mount the process cartridge 10 on the process frame 9 described above can be performed in reverse.

Specifically, the process cartridge 10 is first pulled out upward from the process frame 9.

As the process cartridge 10 is pulled upward, the pivoting portion 42B of the drum coupling 42 pivots clockwise about the upper end portion of the coupled portion 45 in a front view and is displaced from the first horizontal position to the first inclined position. When the process cartridge 10 is completely detached from the process frame 9, the pivoting portion 42B is detached from the output portion 35B of the corresponding drum relay coupling 35.

Similarly, as the process cartridge 10 is pulled upward, the pivoting portion 41B of the developing coupling 41 pivots clockwise about the upper end portion of the coupled portion 47 in a front view and is displaced from the second horizontal position to the second inclined position. When the process cartridge 10 is completely detached from the process frame 9, the pivoting portion 41B is detached from the output portion 34B of the corresponding developing relay coupling 34.

(4-2) Mounting of the Process Unit in the Main Casing

For mounting the process cartridges 10 in the main casing 2, the process unit 5 (the process frame 9 with the process cartridges 10 mounted therein) is pushed rearward into the main casing 2 to be accommodated therein. The process unit 5 thus moves from the pull-out position (shown in FIG. 4) to the mounted position (shown in FIG. 1).

When the process unit 5 is in the mounted position, each drum relay coupling 35 is positioned to oppose the corresponding drum main-body coupling 52 in the left-right direction with a predetermined distance therebetween. At this time, the drum main-body coupling 52, drum relay coupling 35, and drum coupling 42 are coaxially aligned with one another in the left-right direction. That is, central axes of the drum main-body coupling 52, drum relay coupling 35, and drum coupling 42 are aligned with one another or substantially coincident with one another.

Likewise, each developing relay coupling 34 is positioned to oppose and be separated from the corresponding developing main-body coupling 51 in the left-right direction. At this time, the developing main-body coupling 51, developing relay coupling 34, and developing coupling 41 are coaxially aligned with one another in the left-right direction. That is, central axes of the developing main-body coupling 51, developing relay coupling 34, and developing coupling 41 are aligned with one another, or substantially coincident with one another.

Incidentally, each relay electrode 36 is positioned to oppose the corresponding main-body electrode 53 in the left-right direction with a distance kept therebetween.

Then, the front cover 4 is closed. In association with closing of the front cover 4, each of the drum main-body couplings 52 is displaced to the first driving-force transmission position as shown in FIG. 3. The engaging protrusion 54 of each drum main-body coupling 52 advances rightward and is fitted with the input portion 35A of the corresponding drum relay coupling 35. The engaging protrusion 54 is thus coupled to the input portion 35A so as not to rotate relative to each other.

Likewise, each of the developing main-body couplings 51 is displaced to the second driving-force transmission position. As a result, the engaging protrusion 55 of each developing main-body coupling 51 is inserted into and fitted with the input portion 34A of the corresponding developing relay coupling 34 from its right side. The engaging protrusion 55 is thus coupled to the input portion 34A so as not to rotate relative to each other.

In the meantime, each of the main-body electrodes 53 is also displaced to its power supplying position as the front cover 4 closes. Each main-body electrode 53 comes in contact with the corresponding relay electrode 36 from its left side.

For executing an image formation operation, the input portion 35A of each drum relay coupling 35 is configured to receive a drive force from the corresponding drum main-body coupling 52. Hence, each of the drum couplings 42 receives the drive force from the output portion 35B of the corresponding drum relay coupling 35.

Likewise, the input portion 34A of each developing relay coupling 34 is configured to receive a drive force from the corresponding developing main-body coupling 51. Each of the developing couplings 41 thus receives the drive force from the output portion 34B of the corresponding developing relay coupling 34.

Each of the cartridge electrodes 43 is supplied with power from the corresponding main-body electrode 53 through the corresponding relay electrode 36.

For withdrawing the process unit 5 from the main casing 2, the front cover 4 is first opened. In association with opening of the front cover, each of the drum main-body couplings 52 is displaced to its first driving-force-transmission cancellation position, as indicated by the imaginary line in FIG. 3. As a result, the engaging projection portion 54 of each drum main-body coupling 52 is separated from the input portion 35A of the corresponding drum relay coupling 35.

Likewise, each of the developing main-body couplings 51 is displaced to the second driving-force-transmission cancellation position. As a result, the engaging projection portion 55 of each developing main-body coupling 51 is detached from the input portion 34A of the corresponding developing relay coupling 34.

In the meantime, each of the main-body electrodes 53 is displaced to the power-supply cancellation position. Each main-body electrode 53 is thus separated from the corresponding relay electrode 36.

Once the drum main-body couplings 52, developing main-body couplings 51 and the main-body electrodes 53 have all been detached from the corresponding drum relay couplings 35, developing relay couplings 34 and relay electrodes 36, the process unit 5 is now ready to be pulled out from the main casing 2. The process unit 5 is thus pulled out to move from the mounted position to the pull-out position.

5. Operations and Technical Advantages (1) As shown in FIG. 3, the printer 1 of the first embodiment can transmit the drive force from the developing main-body couplings 51 to the developing couplings 41 via the developing relay couplings 34.

Incidentally, suppose a drive force is to be transmitted directly from the developing main-body couplings 51 to the developing couplings 41. In this case, the developing main-body couplings 51 need to be engaged with the developing couplings 41 via openings that should be formed in the process frame 9. Such structure may possibly make it difficult to shorten a distance by which the developing main-body couplings 51 need to move (advance and retract) relative to the developing couplings 41.

If the distance by which the developing main-body couplings 51 move relative to the developing couplings 41 is long, the printer 1 may become larger in size with respect to the direction in which the developing main-body couplings 51 move (or in the left-right direction).

In contrast thereto, according to the printer 1 of the present embodiment, the process frame 9 is provided with the developing relay couplings 34. Therefore, the developing main-body couplings 51 are required to move only by such a distance short enough to reach the corresponding developing relay couplings 34 to be engaged therewith for transmitting the drive force to the developing couplings 41.

Consequently, the distance by which the developing main-body couplings 51 need to move can be shortened. As a result, the printer 1 can be made smaller in size.

(2) According to the printer 1 of the present embodiment, the central axis (rotational axis) of each developing coupling 41 is substantially coincident with the central axis (rotational axis) of each developing main-body coupling 51, as shown in FIG. 3.

Therefore, the rotation of the developing main-body couplings 51 can be accurately synchronized with the rotation of the developing couplings 41.

(3) Even though the printer 1 includes the plurality of process cartridges 10, the printer 1 of the present embodiment can be made compact.

(4) According to the printer 1 of the present embodiment, engagement between the pivoting portions 41B of the developing couplings 41 and the output portions 34B of the corresponding developing relay couplings 34 can be realized in conjunction with mounting operations of the process cartridges 10 on the process frame 9. In other words, mounting of the process cartridges 10 on the process frame 9 can establish mechanical connections between the developing couplings 41 and the developing relay couplings 34 through which the drive force can be transmitted.

Further, engagement between the pivoting portions 41B of the developing couplings 41 and the output portions 34B of the developing relay couplings 34 can be released through detachment of the process cartridges 10 from the process frame 9.

Therefore, in the process frame 9 provided with the developing relay couplings 34, the operations to attach/detach the process cartridges 10 relative to the process frame 9, as well as the operations to engage/disengage the developing couplings 41 relative to the developing relay couplings 34 can be performed smoothly.

6. Second Embodiment

Next, detailed constructions of a process cartridge 60 and a process frame 209 according to a second embodiment of the present invention will be described with reference to FIGS. 6A and 6B. In the following description, like parts and components designated by the same reference numerals with those of the first embodiment to avoid duplicating description.

(6-1) Overview of the Second Embodiment

In the first embodiment, the developing coupling 41 of the process cartridge 10 includes the pivotably movable pivoting portion 41B. The pivoting portion 41B of the developing coupling 41 is configured to be engaged with the corresponding output portion 34B of the developing relay coupling 34 provided in the process frame 9 in conjunction with the mounting of the process cartridge 10 on the process frame 9.

In contrast, the according to the second embodiment, the process frame 209 is provided with four developing relay couplings 61 configured to slide in the left-right direction. As shown in FIG. 6A, a process unit 205 (the process frame 209 on which the process cartridges 60 are mounted) is first displaced to the mounted position. Subsequently, as shown in FIG. 6B, the developing relay couplings 61 are pushed leftward as developing main-body couplings 51 advance and engage with input portions 69 of corresponding developing relay couplings 61. As a result, output portions 70 of the developing relay couplings 61 are respectively inserted into and fitted with coupled portions 63 of developing couplings 62 provided in the respective process cartridges 60.

(6-2) Structures According to the Second Embodiment

(6-2-1) Process Frame

The process frame 209 of the second embodiment is provided with four drum relay couplings 64 and four developing relay couplings 61 to correspond to the four process cartridges 60.

The drum relay couplings 64 are formed as an Oldham coupling. Each drum relay coupling 64 includes a body portion 71 and a relay plate 72.

The body portion 71 is formed in a substantially columnar shape extending in the left-right direction. The body portion 71 includes an input portion 73.

The input portion 73 is formed in a right end portion of the body portion 71 in a form of a recess. Specifically, the input portion 73 is recessed leftward from a right surface of the body portion 71.

The relay plate 72 is formed in a generally circular disk-like shape and has a thickness in the left-right direction. The relay plate 72 is supported to a left end portion of the body portion 71 such that the relay plate 72 is slidable in a radial direction of the body portion 71 but in capable of rotating relative to the body portion 71. The relay plate 72 includes an output portion 74 in a form of protrusion.

The output portion 74 has a generally pillar shape and protrudes leftward from a left end surface of the relay plate 72.

The body portion 71 of the drum relay coupling 64 is supported to the right side plate 31R such that the drum relay coupling 64 can slide in the left-right direction. The drum relay coupling 64 is thus movable between to a first engaged position (shown in FIG. 6B) and a first engagement cancellation position (shown in FIG. 6A). Specifically, the drum relay coupling 64 in the first engaged position is generally aligned with the right side plate 31R in the left-right direction, and the drum relay coupling 64 in the first engagement cancellation position is retracted (offset) rightward relative to the first engaged position. The drum relay coupling 64 is constantly biased rightward toward the first engagement cancellation position by a biasing member (not shown).

The developing relay coupling 61 is formed as an Oldham coupling. Each developing relay coupling 61 includes a body portion 67 and a relay plate 68.

The body portion 67 has a substantially columnar shape extending in the left-right direction. The body portion 67 includes the input portion 69.

The input portion 69 is formed in a right end portion of the body portion 67 in a form of recess. Specifically, the input portion 69 is recessed leftward from a right surface of the body portion 67.

The relay plate 68 has a generally circular disk-like shape and has a thickness in the left-right direction. The relay plate 68 is supported to a left end portion of the body portion 67 such that the relay plate 68 is slidable in a radial direction of the body portion 67 but is incapable of rotating relative to the body portion 67. The relay plate 68 includes the output portion 70 in a form of protrusion.

The output portion 70 has a generally pillar-like shape and protrudes leftward from a left end surface of the relay plate 68.

The body portion 67 of the developing relay coupling 61 is supported to the right side plate 31R such that the developing relay coupling 61 can slide in the left-right direction. The developing relay coupling 61 is thus movable between a second engaged position (shown in FIG. 6B) and a second engagement cancellation position (shown in FIG. 6A). Specifically, the developing relay coupling 61 in the second engaged position is aligned with the right side plate 31R in the left-right direction, whereas the developing relay coupling 61 in the second engagement cancellation position is retracted (offset) leftward relative to the second engaged position. The developing relay coupling 61 is constantly biased rightward toward the second engagement cancellation position by a biasing member (not shown).

(6-2-2) Process Cartridges

The process cartridge 60 of the second embodiment is provided with a drum coupling 65 and a developing coupling 62.

The drum coupling 65 is formed in a substantially columnar shape extending in the left-right direction. The drum coupling 65 is non-rotatably supported to the right end portion of a photosensitive drum 11. The drum coupling 65 includes a coupled portion 66.

The coupled portion 66 is formed in a right end portion of the drum coupling 65. The coupled portion 66 is formed as a recess depressed leftward from a right surface of the drum coupling 65.

The developing coupling 62 has a substantially columnar shape extending in the left-right direction. The developing coupling 62 is rotatably supported to a right end portion of the process cartridge 60 and is positioned upward and frontward of the drum coupling 65. Although not shown in the drawings, the developing coupling 62 has a left end portion whose entire circumferential surface is formed with gear teeth thereon. The gear teeth are in engagement with a gear train (not shown) to mechanically connect the developing coupling 62 to the developing roller 13.

The developing coupling 62 includes the coupled portion 63.

The coupled portion 63 is formed in a right end portion of the developing coupling 62. Specifically, the coupled portion 63 is formed as a recess depressed leftward from a right surface of the developing coupling 62.

(6-3) Mounting Operation of the Process Cartridges (6-3-1) Mounting of Process Cartridges on the Process Frame For mounting the process cartridges 60 in the main casing 2, first, the process frame 209 is withdrawn to the pull-out position shown in FIG. 4, as in the first embodiment. Then, the process cartridges 60 are mounted on the process frame 209 withdrawn from the main casing 2.

For mounting the process cartridge 60 on the process frame 209, first, the process cartridge 60 is held with the photosensitive drum 11 facing downward. The process cartridge 60 is then placed above the process frame 209 and inserted into the process frame 209 from above.

Accordingly, lower end portions of both left and right end portions of the process cartridge 60 are respectively brought into contact with the support ribs 37 formed on the side plates 31 from above. Mounting of the process cartridge 60 on the process frame 209 is thus completed.

Figure 6A:
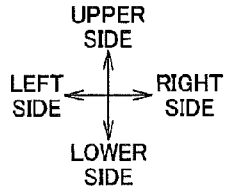
FIG. 6A is a view explaining a process frame and a cartridge according to a second embodiment of the present invention, wherein the process frame supporting the plurality of process cartridges has been mounted in the main casing and the front cover of the main casing is opened.
Figure 6A:
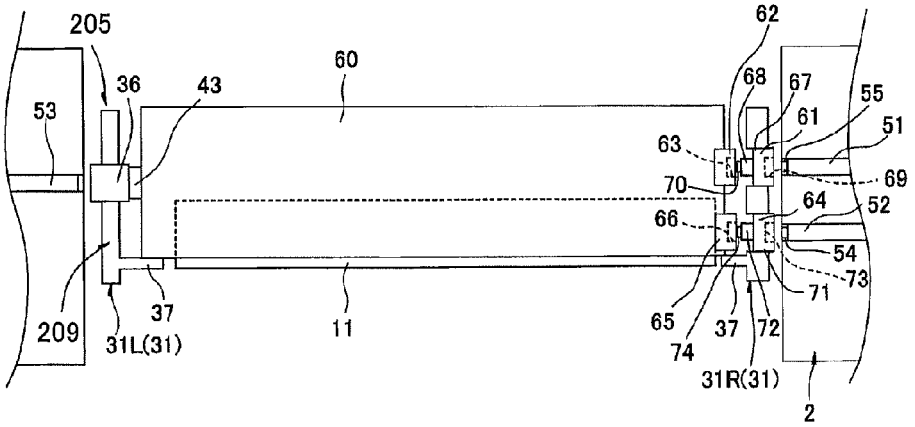
Figure 6B:
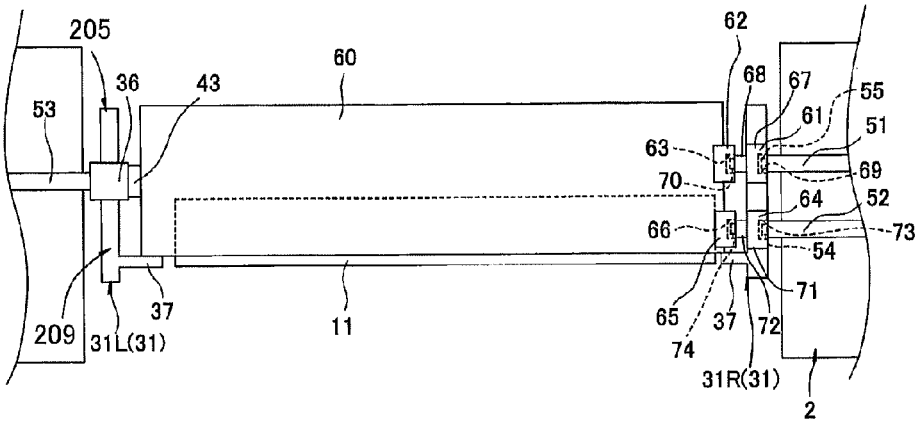
FIG. 6B is a view explaining the process frame and the cartridge according to the second embodiment, wherein the process frame has been mounted in the main casing and the front cover is closed.

Incidentally, when the process cartridge 60 is mounted on the process frame 209, the cartridge electrode 43 of the process cartridge 60 is received by the corresponding relay electrode 36 of the process frame 209 (see FIG. 6A).

For detaching the process cartridge 60 from the process frame 209, the process cartridge 60 is pulled upward from the process frame 209.

(6-3-2) Mounting of the Process Unit in the Main Casing

For mounting the process cartridges 10 in the main casing 2, the process unit 205 (the process frame 209 with the process cartridges 60 mounted thereon) is pushed rearward into the main casing 2. The process unit 205 is thus displaced from the pull-out position to the mounted position.

When the process unit 205 is in the mounted position, each drum relay coupling 64 is positioned as to oppose the corresponding drum main-body coupling 52 while being separated therefrom in the left-right direction. At this time, the drum main-body coupling 52, drum relay coupling 64, and drum coupling 65 are coaxially aligned with one another in the left-right direction. That is, central axes of the drum main-body coupling 52, drum relay coupling 64, and drum coupling 65 are aligned with one another, or substantially coincident with one another.

Likewise, each developing relay coupling 61 is positioned in opposition to and in separation from the corresponding developing main-body coupling 51 in the left-right direction. At this time, the developing main-body coupling 51, developing relay coupling 61, and developing coupling 62 are coaxially aligned with one another in the left-right direction. In other words, central axes of the developing main-body coupling 51, developing relay coupling 61, and developing coupling 62 are aligned with one another or substantially coincident with one another.

Incidentally, each relay electrode 36 of the process frame 209 is positioned to oppose the corresponding main-body electrode 53 in the left-right direction with a predetermined distance kept therebetween.

Then, the front cover 4 is closed. In association with closing of the front cover 4, each of the drum main-body couplings 52 is displaced to the first driving-force transmission position. The engaging protrusion 54 of each drum main-body coupling 52 thus advances leftward to be fitted with the input portion 73 of the corresponding drum relay coupling 64. As a result, the engaging protrusion 54 is coupled to the input portion 73 so as not to rotate relative to each other.

Incidentally, the drum relay coupling 64 as a whole is pushed and slid leftward as the engaging protrusion 54 is coupled to the input portion 73.

As a result of the sliding of the drum relay coupling 64, the output portion 74 of the drum relay coupling 64 is fitted into the coupled portion 66 of the corresponding drum coupling 65 from its right side. The output portion 74 of the drum relay coupling 64 is thus coupled to the coupled portion 66 of the drum coupling 65 so as not to rotate relative to each other.

Likewise, each developing main-body coupling 51 is displaced to the second driving-force transmission position in association with closing of the front cover 4. The engaging protrusion 55 of each developing main-body coupling 51 advances leftward and is fitted into the input portion 69 of the corresponding developing relay coupling 61 from its right side. The engaging protrusion 55 of the developing main-body coupling 51 is thus coupled to the input portion 69 of the developing relay coupling 61 so as not to rotate relative to each other.

The developing relay coupling 61 as a whole is pushed and slid leftward as the developing main-body coupling 51 is coupled to the developing relay coupling 61.

As a result of the sliding of the developing relay coupling 61, the output portion 70 of the developing relay coupling 61 is fitted into the coupled portion 63 of the corresponding developing coupling 62 from its right side. The output portion 70 of the developing relay coupling 61 is thus coupled to the coupled portion 63 of the developing coupling 62 so as not to rotate relative to each other.

In the meantime, each of the main-body electrodes 53 is also displaced to its power supplying position as the front cover 4 closes. Each main-body electrode 53 comes in contact with the corresponding relay electrode 36 from its left side.

For executing an image formation operation, each drum couplings 65 is configured to receive a drive force from the corresponding drum main-body coupling 52 via the corresponding drum relay coupling 64.

Likewise, each developing coupling 62 is configured to receive a drive force from the corresponding developing main-body coupling 51 via the corresponding developing relay coupling 61.

Further, each cartridge electrode 43 is supplied with power from the corresponding main-body electrode 53 through the corresponding relay electrode 36.

7. Operations and Technical Advantages of the Second Embodiment (7-1) According to the above-described structure of the second embodiment, when the developing main-body coupling 51 is in the second driving-force-transmission cancellation position as shown in FIG. 6A, the developing relay coupling 61 is retracted from the developing coupling 62 and is placed in the second engagement cancellation position due to the biasing force of the biasing member (not shown).

Therefore, no interference occurs between the process cartridge 60 and the corresponding developing relay coupling 61 during attachment/detachment of the process cartridge 60 relative to the process frame 209.

As a result, smooth attachment and detachment of the process cartridge 60 relative to the process frame 209 can be ensured.

(7-2) In the second embodiment, the developing relay coupling 61 is formed as an Oldham coupling Therefore, even if the central axis of the developing relay coupling 61 is slightly displaced (offset) from the central axis of the corresponding developing coupling 62, the relay plate 68 of the developing relay coupling 61 can slide relative to the body portion 67. Hence, the output portion 70 of the developing relay coupling 61 can be smoothly received in and fitted to the coupled portion 63 of the corresponding developing coupling 62.

8. Variations and Modifications

In the depicted embodiments, the developing roller 13 is an example of a claimed rotary body. However, the photosensitive drum 11 may be an alternative example of the claimed rotary body.

In this case, taking the first embodiment as an example, the drum coupling 42, drum relay coupling 35, drum main-body coupling 52, pivoting portion 42B of the drum coupling 42 may correspond to claimed drive-force transmission part, drive-force relay part, drive-force supplying part and coupling, respectively.

Taking the second embodiment as an example, the drum coupling 65, drum relay coupling 64 and the drum main-body coupling 52 may correspond to the claimed drive-force transmission part, drive-force relay part and drive-force supplying part, respectively.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main body provided with a drive-force supplying part configured to rotate to generate and transmit a drive force;

a cartridge comprising:

an image carrier configured to carry an electrostatic latent image thereon and defining a first rotational axis extending in a first direction;

a developer carrier configured to carry developer thereon and defining a second rotational axis extending in the first direction;

an image-carrier drive-force transmission part configured to transmit the drive force from the drive-force supplying part to the image carrier; and a developer-carrier drive-force transmission part configured to transmit the drive force from the drive-force supplying part to the developer carrier; and a moving member configured to support the cartridge therein and to move in a second direction generally perpendicular to the first direction between an internal position accommodated in the main body and an external position withdrawn from the main body, the cartridge being configured to be attached to and detached from the moving member at the external position, the moving member comprising:

an image-carrier drive-force relay part including an image-carrier input portion and an image-carrier output portion, the image-carrier input portion being configured to receive the drive force from the drive-force supplying part of the main body, the image-carrier output portion being configured to output the drive force from the image-carrier input portion to the image-carrier drive-force transmission part of the cartridge attached to the moving member; and a developer-carrier drive-force relay part including a developer-carrier input portion and a developer-carrier output portion, the developer-carrier input portion being configured to receive the drive force from the drive-force supplying part of the main body, the developer-carrier output portion being configured to output the drive force from the developer-carrier input portion to the developer-carrier drive-force transmission part of the cartridge attached to the moving member.

2. The image forming apparatus as claimed in claim 1, wherein the cartridge has one end in the first direction, the image-carrier drive-force transmission part being disposed on the one end, wherein the moving member has one end opposing the one end of the cartridge in the first direction when the cartridge is supported to the moving member, the image-carrier drive-force relay part and the developer-carrier drive-force relay part being disposed on the one end of the moving member such that the image-carrier input portion and the image-carrier output portion are positioned opposite to each other in the first direction and the developer-carrier input portion and the developer-carrier output portion are positioned opposite to each other in the first direction, the image-carrier output portion facing the image-carrier drive-force transmission part in the first direction and being configured to be engaged with the image-carrier drive-force transmission part to transmit the drive force thereto when the cartridge is supported to the moving member, the developer-carrier output portion facing the developer-carrier drive-force transmission part in the first direction and being configured to be engaged with the developer-carrier drive-force transmission part to transmit the drive force thereto when the cartridge is supported to the moving member, wherein the main body has one end opposing the one end of the moving member in the first direction when the moving member is in the internal position, the drive-force supplying part including an image-carrier drive-force supplying part and a developer-carrier drive-force supplying part, the image-carrier drive-force supplying part being disposed on the one end of the main body to face the image-carrier input portion in the first direction and configured to be engaged with the image-carrier input portion to transmit the drive force thereto when the moving member is in the internal position, the developer-carrier drive-force supplying part being disposed on the one end of the main body to face the developer-carrier input portion in the first direction and configured to be engaged with the developer-carrier input portion to transmit the drive force thereto when the moving member is in the internal position, and wherein the image-carrier drive-force transmission part is configured to rotate about a rotational axis generally parallel to the first direction and substantially coincident with a rotational axis of the image-carrier drive-force supplying part, the developer-carrier drive-force transmission part being configured to rotate about a rotational axis generally parallel to the first direction and substantially coincident with a rotational axis of the developer-carrier drive-force supplying part.

3. The image forming apparatus as claimed in claim 2, wherein the image-carrier drive-force transmission part comprises an image-carrier coupling configured to be engaged with the image-carrier output portion when the cartridge is supported to the moving member, the image-carrier coupling having a base end pivotally movably supported to the one end of the cartridge and extending away from the one end of the cartridge, the image-carrier coupling being pivotally movable between a first position where the image-carrier coupling is oriented in a direction generally parallel to the first direction and a second position where the image-carrier coupling is oriented in a direction slanted relative to the first direction, wherein the image-carrier coupling is caused to move from the second position to the first position to be engaged with the image-carrier output portion during attachment of the cartridge to the moving member, wherein the image-carrier coupling is caused to move from the first position to the second position to be disengaged from the image-carrier output portion during detachment of the cartridge from the moving member, wherein the developer-carrier drive-force transmission part comprises a developer-carrier coupling configured to be engaged with the developer-carrier output portion when the cartridge is supported to the moving member, the developer-carrier coupling having a base end pivotally movably supported to the one end of the cartridge and extending away from the one end of the cartridge, the developer-carrier coupling being pivotally movable between a third position where the developer-carrier coupling is oriented in a direction generally parallel to the first direction and a fourth position where the developer-carrier coupling is oriented in a direction slanted relative to the first direction, wherein the developer-carrier coupling is caused to move from the fourth position to the third position to be engaged with the developer-carrier output portion during attachment of the cartridge to the moving member, and wherein the developer-carrier coupling is caused to move from the third position to the fourth position to be disengaged from the developer-carrier output portion during detachment of the cartridge from the moving member.

4. The image forming apparatus as claimed in claim 1, wherein the cartridge comprises a plurality of cartridges juxtaposed in the second direction.

5. The image forming apparatus as claimed in claim 1, wherein the image-carrier drive-force relay part is movable between an advanced position and a retracted position relative to the image-carrier drive-force transmission part of the cartridge, the image-carrier drive-force relay part in the advanced position advancing toward the image-carrier drive-force transmission part to be engaged therewith, the image-carrier drive-force relay part in the retracted position being retracted from the image-carrier drive-force transmission part to be disengaged therefrom, and wherein the developer-carrier drive-force relay part is movable between an advanced position and a retracted position relative to the developer-carrier drive-force transmission part of the cartridge, the developer-carrier drive-force relay part in the advanced position advancing toward the developer-carrier drive-force transmission part to be engaged therewith, the developer-carrier drive-force relay part in the retracted position being retracted from the developer-carrier drive-force transmission part to be disengaged therefrom.

6. The image forming apparatus as claimed in claim 5, wherein the image-carrier drive-force relay part comprises an Oldham coupling and the developer-carrier drive-force relay part comprises an Oldham coupling.

7. An image forming apparatus comprising:

a main body provided with a drive-force supplying member configured to transmit a drive force;

a tray configured to move into or be pulled out of the main body; and a cartridge configured to be attached to and detached from the tray, the cartridge comprising an image carrier, a developer carrier, an image-carrier drive-force transmission member and a developer-carrier drive-force transmission member, the image-carrier drive-force transmission member being configured to transmit the drive force from the drive-force supplying member of the main body to the rotary body image carrier, the developer-carrier drive-force transmission member being configured to transmit the drive force from the drive-force supplying member of the main body to the developer carrier, wherein the tray comprises an image-carrier drive-force relay member and a developer-carrier drive-force relay member configured to transmit the drive force from the drive-force supplying member of the main body respectively to the image-carrier drive-force transmission member of the cartridge and the developer-carrier drive-force transmission member of the cartridge.

* * * * *